US010851677B2

(12) United States Patent
Collins et al.

(10) Patent No.: US 10,851,677 B2
(45) Date of Patent: Dec. 1, 2020

(54) BOILER WITH INTEGRATED AIR COMPRESSOR

(71) Applicant: Ingersoll-Rand Industrial U.S., Inc., Davidson, NC (US)

(72) Inventors: James Christopher Collins, Mooresville, NC (US); Markian I Krisa, Huntersville, NC (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 226 days.

(21) Appl. No.: 14/839,582

(22) Filed: Aug. 28, 2015

(65) Prior Publication Data

US 2017/0058716 A1 Mar. 2, 2017

(51) Int. Cl.
*F01K 23/10* (2006.01)
*F01K 11/02* (2006.01)

(52) U.S. Cl.
CPC ..... *F01K 23/101* (2013.01); *F01K 11/02* (2013.01)

(58) Field of Classification Search
CPC ..... F01K 23/062; F01K 23/10; F01K 23/101; F01K 23/106; F01K 23/108; F01K 11/02; F01K 3/185; F01K 21/047; F02C 6/06; F02C 6/08; F02C 6/18; F02C 7/08; F02C 3/34; Y02E 20/16
USPC ..... 60/775, 39.182, 676, 679, 681, 698
See application file for complete search history.

(56) References Cited

U.S. PATENT DOCUMENTS 3,335,565 A 8/1967 Aguet
3,953,966 A * 5/1976 Martz ..... F01K 13/02 60/783
3,955,358 A * 5/1976 Martz ..... F01K 13/02 122/451 S
4,340,820 A * 7/1982 Meyer-Pittroff ..... F01K 13/006 290/40 R
4,637,212 A 1/1987 Aguet
5,044,152 A * 9/1991 Hoizumi ..... F01K 23/101 60/39.182

(Continued)

OTHER PUBLICATIONS

Wlodarski, Mike, HydroThrift Corporation, Heat-Reclaim Economics of Air and Water-Cooled Air Compressors, http://www.airbestpractices.com/sustainability-projects/boilers/heat-reclaim-economics-air-and-water-cooled-air-compressors.

(Continued)

*Primary Examiner* — Jesse S Bogue
*Assistant Examiner* — Loren C Edwards
(74) *Attorney, Agent, or Firm* — Taft Stettinius & Hollister LLP

(57) ABSTRACT

An integrated power generation system is provided. The system includes an heat source that produces a first gas flow to power a turbine operatively coupled to a compressor. The first gas flow can also heat a feedwater flow passing through a boiler. The compressor can produce a second gas flow that may be divided in two portions, the first portion flowing back to the heat source and the second portion flowing to an end user. Also, the second portion may be routed through an air cooler to dissipate heat to the feedwater flow to cool the second portion as well as preheat the feedwater flow prior to entering the boiler. The first portion can also exchange heat with the first gas flow exiting the boiler prior to the first portion entering the heat source. The boiler operation and the compressor operation are operable independently or concurrently.

22 Claims, 7 Drawing Sheets

(56) References Cited

U.S. PATENT DOCUMENTS

| | | | | |
|---|---|---|---|---|
| 5,241,816 | A | 9/1993 | Drnevich | |
| 5,309,707 | A * | 5/1994 | Provol | F01D 21/00 60/39.25 |
| 5,386,685 | A | 2/1995 | Frutschi | |
| 6,032,456 | A * | 3/2000 | Easom | F01K 23/067 60/39.12 |
| 6,105,362 | A * | 8/2000 | Ohtomo | F01K 23/10 60/39.182 |
| 6,442,941 | B1 | 9/2002 | Anand et al. | |
| 6,543,234 | B2 | 4/2003 | Anand et al. | |
| 6,588,196 | B1 | 7/2003 | Bahr et al. | |
| 7,007,453 | B2 | 3/2006 | Maisotsenko et al. | |
| 7,269,956 | B2 | 9/2007 | Gericke et al. | |
| 9,074,494 | B2 * | 7/2015 | Pang | F22G 5/04 |
| 2007/0017207 | A1 | 1/2007 | Smith et al. | |
| 2010/0170218 | A1 * | 7/2010 | Eluripati | F01K 23/106 60/39.183 |
| 2010/0242429 | A1 * | 9/2010 | Smith | F01K 23/106 60/39.182 |

OTHER PUBLICATIONS

Moskowitz, Frank, Heat Recovery and Compressed Air Systems, https://www.compressedairchallenge.org/library/articles/2010-09-CABP.pdf.

* cited by examiner

BOILER WITH INTEGRATED AIR COMPRESSOR

BACKGROUND

Technical Field

The present disclosure relates to power-generation systems, and, in particular, to a boiler and a compressor within an integrated system.

State of the Art

Thermodynamic processes typically require one or more energy sources of some variety to operate. Using the energy sources, these thermodynamic processes perform their designed function and in so doing may produce byproducts. Some of these energy sources and byproducts may be heat related.

Accordingly, it is desirable to provide methods and systems for power generation that could maximize the thermodynamic properties of the various system components to effectively and efficiently produce power.

SUMMARY

The present disclosure relates to power-generation systems, and, in particular, to an integrated boiler and compressor system.

An aspect of the present disclosure includes an integrated power generation system comprising: an heat source configured to produce a first gas flow; an expander arranged downstream of the heat source and configured to receive the first gas flow; a boiler arranged downstream of the expander and configured to receive the first gas flow from the expander to heat a feedwater flow through the boiler; a compressor operatively coupled to and driven by the expander, the compressor being configured to produce a second gas flow, wherein a first portion of the second gas flow is provided to the heat source and a second portion of the second gas flow is provided to a point of use; an heat exchanger arranged upstream of the boiler in the feedwater flow and downstream of the compressor in the second portion of the second gas flow, the heat exchanger being configured to exchange heat between the second portion of the second gas flow and the feedwater flow to preheat the feedwater flow prior to entering the boiler; and a second heat exchanger arranged downstream of the boiler in the first gas flow and downstream of the compressor in the first portion of the second gas flow, the second heat exchanger being configured to exchange heat between the first gas flow and the first portion of the second gas flow to preheat the first portion of the second gas flow prior to entering the heat source.

Another aspect of the present disclosure includes an integrated power generation system comprising: an heat source configured to produce a first gas flow; an expander arranged downstream of the heat source and configured to receive the first gas flow; a boiler arranged downstream of the expander and configured to receive the first gas flow from the expander to heat a feedwater flow through the boiler; a compressor operatively coupled to and driven by the expander, the compressor being configured to produce a second gas flow, wherein a first portion of the second gas flow is provided to the heat source and a second portion of the second gas flow is provided to a point of use; and control valves arranged in the system, wherein the control valves are configured to transition the system between one of a first operation state, a second operation state, and a joint operation state.

Another aspect of the present disclosure includes a method of producing power from an integrated power generation system, the method comprising: producing a first gas flow from a heat source; generating torque from the first gas flow to operate a compressor; exchanging heat in a boiler between the first gas flow and a feedwater flow; producing a second gas flow from the compressor; providing a first portion of the second gas flow to the heat source; providing a second portion of the second gas flow to a point of use; exchanging heat between the second portion of the second gas flow downstream of the compressor and the feedwater flow upstream of the boiler; and exchanging heat between the first portion of the second gas flow downstream of the compressor and the first gas flow downstream of the boiler.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

Figure 1:
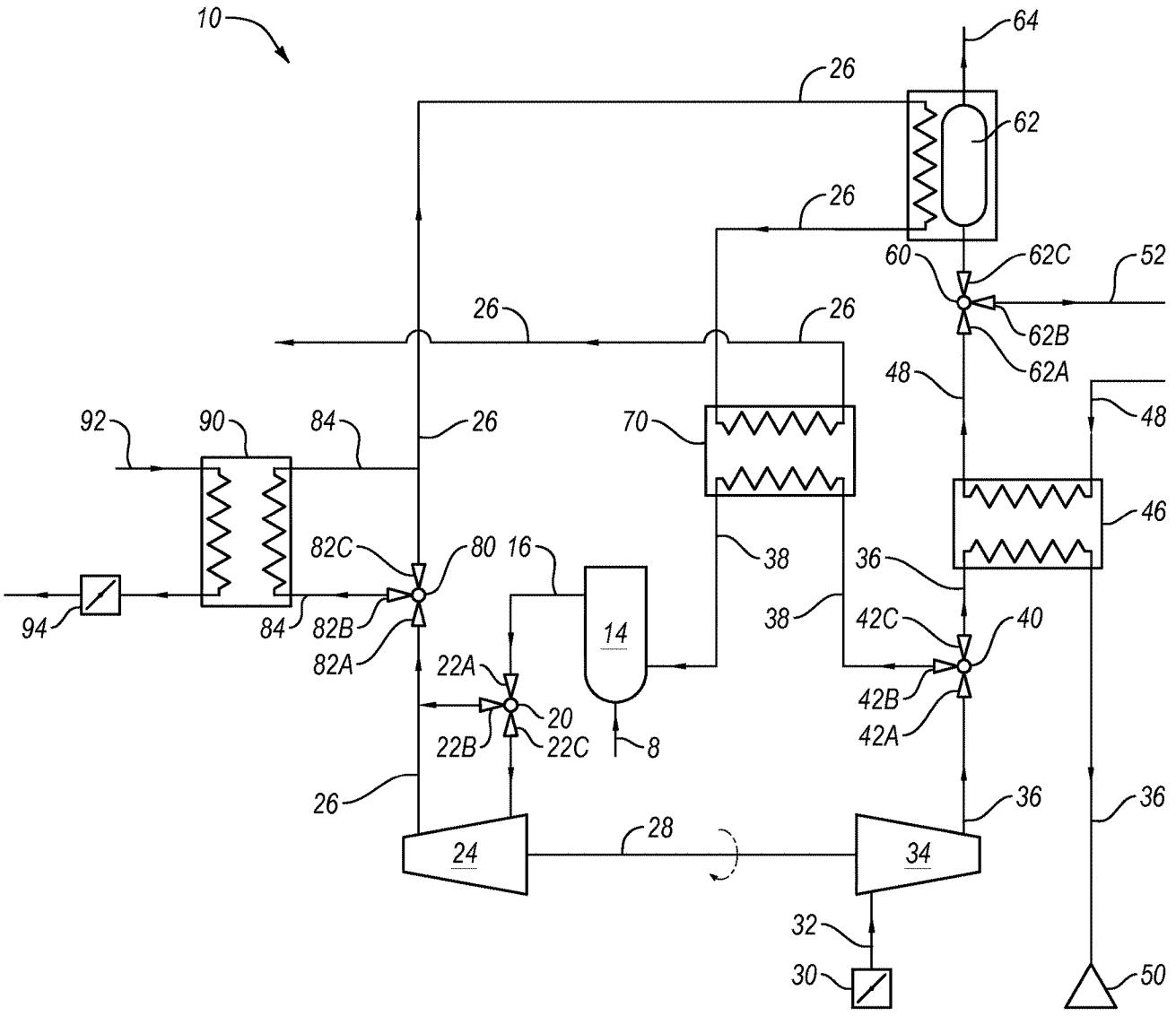
FIG. 1 is a schematic diagram of an illustrative embodiment of an integrated boiler and compressor system in accordance with the present disclosure.

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

The drawings depict illustrative embodiments of an integrated boiler and compressor system 10. These embodiments may each comprise various structural and functional components, including for example, but not limited thereto, a heat source 14, a turbine component 24, a compressor 34, and a boiler 62, that complement one another to provide the unique functionality and performance of the system 10, the particular structure and function of which will be described in greater detail herein.

Referring to the drawings, FIG. 1 depicts an illustrative embodiment of an integrated boiler and compressor system 10. Embodiments of the system 10 may comprise a heat source 14. The heat source 14 may be a combustion heater configured to produce energy in the form of a hot gas flow. For example, the combustion heater may be configured to receive a combustion fuel 8 and a compressed gas, to be described in greater detail herein, and thereafter ignite and burn the combustion fuel 8 to generate a hot gas flow that emanates from the heat source 14. The hot gas flow may leave the heat source 14 through a line 16.

Embodiments of the system 10 may comprise a turbine component 24. The turbine component 24 may be, for example, but not limited thereto, an expander, a turboexpander, an expansion turbine or other gas turbine. The turbine component 24 may be configured to receive the hot gas flow from the line 16 and utilize the expanding hot gas flow to generate torque and power to drive a drive shaft 28. The hot gas flow may continue through the turbine component 24 and exit therefrom through the line 26. The line 26 may be configured to direct the hot gas flow to a boiler 62, which will be described in greater detail herein.

Embodiments of the system 10 may comprise a compressor 34. The compressor 34 may be, for example, but not limited thereto, a centrifugal compressor, a rotary screw compressor, a radial flow impeller, an axial flow impeller, or other compatible compressor design. The compressor 34 may be operatively coupled to and driven by the drive shaft 28. Accordingly, the operation of the turbine component 24 may power the drive shaft 28 to operate the compressor 34. The turbine component 24 and the compressor 34 may be operatively coupled in a direct manner via the drive shaft 28, or, in the alternative, the turbine component 24 and the compressor 34 may be operatively coupled to one another with a transmission (not depicted) therebetween to govern and control the operations of the compressor 34 from the torque and power generated by the turbine component 24, the transmission having gears, clutching, belts and sheaves, sprockets and chains, and combinations of these drivetrain components (not depicted).

The compressor 34 may be configured to receive a gas flow from a line 32 governed by a control valve 30. The control valve 30 may be configured to adjust, regulate, and otherwise modulate the flow volume and flow rate of a gas, such as air, passing through the control valve 30 and through the line 32 into the compressor 34.

The compressor 34 may be configured to receive the regulated gas flow from line 32 and compress the gas into a smaller volume to thereby increase the pressure of the gas flow. The pressurized gas flow may thereafter leave the compressor 34 through a line 36. Embodiments of the system 10 may comprise the pressurized gas flow leaving the compressor 34 and being directed through the line 36 to a point of use 50. The point of use 50 may be an end user U who is able to utilize the pressurized gas flow from the compressor 34 as a source of energy and/or power. For example, the user U may utilize the pressurized gas flow from the compressor 34 for operating pneumatic equipment, compressed air tools, and other pneumatic accessories, such as, for example, and not limited to, pneumatic sprayers, blowers, sanders, impact wrenches, grinders, and the like.

Embodiments of the system 10 may further comprise a first heat exchanger 46. The first heat exchanger 46 may be operatively configured in the flow path of the line 36 between the compressor 34 and the point of use 50. The first heat exchanger 46 may be, for example, an air cooler configured to exchange heat between the pressurized gas flow in line 36 with a fluid, such as water for example, in a feedwater line 48. The fluid in the feedwater line 48 may be configured to enter the first heat exchanger 46 and exchange heat with the pressurized gas flow in line 36. For example, the fluid in the feedwater line 48 may have an initial temperature at ambient levels, whereas, the temperature in the compressed gas flow of the line 36 may have an elevated temperature due to the compression, or pressurization, of the gas through the compressor 34. As a result, the elevated temperature of the compressed gas flow may exchange heat with the lower temperature fluid in the feedwater line 48. The configuration of the first heat exchanger 46 may thus serve the dual purpose of raising the temperature of the fluid flowing through the feedwater line 48 and reducing the temperature of the compressed gas flow flowing through the line 36. In other words, the fluid in the feedwater line 48 may have a higher temperature upon exiting the first heat exchanger 46 than upon entering, and the compressed gas in the line 36 may have a lower temperature upon exiting the first heat exchanger 46 than upon entering.

Embodiments of the system 10 may further comprise a control valve 40 operatively configured in the flow path of the line 36 between the compressor 34 and the first heat exchanger 46. The control valve 40 may be a multi-directional control valve. For example, the control valve 40 may have a plurality of flow ports, such as, for example, flow ports 42A, 42B and 42C. The flow port 42A may be configured as an input port for the compressed gas flow from the compressor 34 to the control valve 40 and may thereby regulate the volume of compressed gas flow that enters the control valve 40. The flow ports 42B and 42C may be configured as exit ports for the compressed gas flow from the control valve 40 and may thereby regulate the volume, and direction, of the compressed gas flow entering and exiting the control valve 40. For example, when the flow ports 42A and 42C are open and the flow port 42B is closed, the compressed gas flow of the line 36 may flow through the control valve 40 to the first heat exchanger 46 and/or the point of use 50, as the case may be. Further in example, when the flow ports 42A and 42B are open and the flow port 42C is closed, the compressed gas flow through the line 36 may change direction at the control valve 40 to flow through a line 38 that directs the compressed gas flow to the heat source 14. Further in example, when the flow ports 42A, 42B and 42C are all open, the compressed gas flow may be divided at the control valve 40, with a first portion of the compressed gas flow being directed out of the flow port 42B through the line 38 that directs the compressed gas flow to the heat source 14 and a second portion of the compressed gas flow being directed out of the flow port 42C through the line 36 that directs the compressed gas flow to the first heat exchanger 46 and/or the point of use 50. These examples serve to highlight just a few of the flow configurations of the compressed gas flow through the control valve 40. Moreover, the control valve 40 may be configured to not only open and close the flow ports 42A, 42B and 42C, but may also regulate, or otherwise modulate, each of the flow ports 42A, 42B and 42C to control and direct the flow rate and volume through each of the lines 36 and 38.

Indeed, the term "control valves" as used herein may be valves configured and operable to independently and individually control conditions such as flow, pressure, temperature, and liquid level by fully or partially opening or closing in response to signals received from controllers that compare a setpoint, or predetermined value, to a process variable whose value is provided by sensors that monitor changes in such conditions. The sensors (not depicted) may be placed in the components of the system 10 as well as the respective lines of flow of the fluids and gases of the system 10 to provide feedback to a control unit (not depicted) that may thereby govern the operation of the various control valves of the system 10 to observe, enhance, optimize, regulate, enrich, or otherwise monitor the operations of the system 10. The sensors may be configured to monitor such conditions as flow, pressure, temperature, and liquid level, just to name a few, in the various components and lines of the system 10.

Embodiments of the system 10 may comprise the heat source 14 being configured to receive the first portion of the compressed gas flow that is directed out of the control valve 40 through the flow port 42B and into the line 38. Once received, the heat source 14 may thereafter utilize the compressed gas to mix, or otherwise combine, with the combustion fuel 8 to combust, or otherwise burn, the combustion fuel 8 to produce the hot gas flow that may be utilized as an energy and/or power source, as herein described.

Embodiments of the system 10 may further comprise a control valve 20 operatively configured in the flow path of the line 16 between the heat source 14 and the turbine component 24. The control valve 20 may be a multi-directional control valve. For example, the control valve 20 may have a plurality of flow ports, such as, for example, flow ports 22A, 22B and 22C. The flow port 22A may be configured as an input port for the hot gas flow from the heat source 14 to the control valve 20 and may thereby regulate the volume of hot gas flow that enters the control valve 20. The flow ports 22B and 22C may be configured as exit ports for the hot gas flow from the control valve 20 and may thereby regulate, or otherwise modulate, the volume and flow rate of the hot gas flow entering and exiting the control valve 20. For example, when the flow ports 22A and 22C are open and the flow port 22B is closed, the hot gas flow of the line 16 may flow through the control valve 20 to the turbine component 24. Further in example, when the flow ports 22A, 22B and 22C are all open, the hot gas flow may be divided at the control valve 20, with a first portion of the hot gas flow being directed out of the flow port 22B through a line 18 that directs the hot gas flow to a line 26 that directs the hot gas flow to a boiler 62 and a second portion of the hot gas flow being directed out of the flow port 22C through the line 16 that directs the hot gas flow to the turbine component 24. These examples serve to highlight just a few of the flow configurations of the hot gas flow through the control valve 20. Moreover, the control valve 20 may be configured to not only open and close the flow ports 22A, 22B and 22C, but may also be configured to regulate, or otherwise modulate, the flow ports 22A, 22B and 22C to control and direct the flow rate and volume through the lines 16, 18 and 26.

Embodiments of the system 10 may comprise a boiler 62. The boiler 62 may be operatively configured in the flow path of the line 26 downstream of the turbine component 24. The boiler 62 may be, for example, a boiler or steam generator configured to heat a fluid, such as water, wherein the heated or vaporized fluid may exit the boiler 62 by way of a line 64 for use in various processes or heating applications, such as water heating, central heating, boiler-based power generation, and the like.

The boiler 62 may be configured to exchange heat between the hot gas flow in the line 26 with the fluid in the feedwater line 48 that enters the boiler 62. The feedwater line 48 may be configured to direct the fluid in the feedwater line 48 from the first heat exchanger 46 to the boiler 62. In other words, after having exchanged heat with the compressed gas in the first heat exchanger 46, the fluid in the feedwater line 48 may enter the boiler 62 in a preheated state, or at least having a temperature higher than the temperature at which the fluid in the feedwater line 48 entered the heat exchanger 46. Thus, as suggested above, by running the feedwater line 48 through the first heat exchanger 46 to draw out the heat from the compressed gas flow in line 36, the first heat exchanger 46 may serve to preheat the temperature of the fluid in the feedwater line 48 prior to the fluid entering the boiler 62.

Once the fluid in the feedwater line 48 enters the boiler 62, the boiler 62 may be configured to provide the conditions wherein heat exchange may take place between the fluid in the feedwater line 48 and the hot gas flow in the line 26 that likewise flows through the boiler 62. The hot gas flow in the line 26 may serve to heat the fluid in the feedwater line 48 to within a workable and/or desirable range, such that the fluid in the feedwater line 48 may exit the boiler 62 as process steam or hot water in the line 64. For example, the temperature of the gas in the hot gas flow of the line 26 that enters the boiler 62 may have an elevated temperature due to the combustion of the combustion fuel 8 in the heat source. As a result, the elevated temperature of the hot gas flow in the line 26 may exchange heat with the fluid in the feedwater line 48 to raise the temperature of the fluid in the feedwater line 48 to acceptable and/or desired power-generation levels, wherein the fluid in the feedwater line 48 becomes process steam or hot water that exits the boiler in the line 64. Moreover, the fluid in the feedwater line 48 may be preheated, as mentioned previously herein, prior to entering the boiler 62. The fluid in the feedwater line 48 may be preheated by flowing through the first heat exchanger 46 and exchanging heat with the elevated temperature of the compressed gas flow in the line 36. Preheating the fluid in the feedwater line 48 prior to the fluid entering the boiler 62 serves to conserve the energy required to heat the fluid in the feedwater line 48 to the acceptable and/or desired power-generation levels by utilizing the heat generated by the operation of the compressor 46 and transferring the heat to the fluid in the feedwater line 48.

Embodiments of the system 10 may further comprise a control valve 60 operatively configured in the flow path of the line 48 between the first heat exchanger 46 and the boiler 62. The control valve 60 may be a multi-directional control valve, such as, for example, a three-way valve. For example, the control valve 60 may have a plurality of flow ports, such as, for example, flow ports 62A, 62B and 62C. The flow port 62A may be configured as an input port for the fluid in the line 48 from the first heat exchanger 46 to the control valve 60 and may thereby regulate the volume of fluid that enters the control valve 60. The flow ports 62B and 62C may be configured as exit ports for the fluid from the control valve 60 and may thereby regulate the volume, and direction, of the fluid entering and exiting the control valve 60. For example, when the flow ports 62A and 62C are open and the flow port 62B is closed, the fluid of the line 48 may flow through the control valve 60 to the boiler 62. Further in example, when the flow ports 62A and 62B are open and the flow port 62C is closed, the fluid flowing through the line 48 may change direction at the control valve 60 to flow through a line 52 that directs the fluid away from and out of the system 10. Further in example, when the flow ports 62A, 62B and 62C are all open, the fluid may be divided at the control valve 60, with a first portion of the fluid being directed out of the flow port 62B through the line 52 that directs the fluid out of the system 10 and a second portion of the fluid being directed out of the flow port 62C through the line 48 that directs the fluid to the boiler 62. These examples serve to highlight just a few of the flow configurations of the compressed gas flow through the control valve 60. Moreover, the control valve 60 may be configured to not only open and close the flow ports 62A, 62B and 62C, but may also regulate, or otherwise modulate, each of the flow ports 62A, 62B and 62C to control and direct the flow rate and volume through each of the lines 48, 52 and 64.

Embodiments of the system 10 may further comprise a second heat exchanger 70. The second heat exchanger 70 may be operatively configured in the flow path of the line 38 between the control valve 40 and the heat source 14 and operatively configured in the flow path of the line 26 downstream from the boiler 62. The second heat exchanger 70 may be, for example, a recuperator configured to provide the conditions in which heat exchange may take place between the hot gas flow in the line 26 leaving the boiler 62 and the compressed gas flow in the line 38 prior to entering the heat source 14. For example, the hot gas flow in the line 26 may be configured to enter the second heat exchanger 70 and exchange heat with the compressed gas flow flowing through the second heat exchanger 70 in the line 38. As a result, within the second heat exchanger 70, the elevated temperature of the hot gas flow in the line 26 may exchange heat with the compressed gas flow in the line 38 to raise the temperature of the compressed gas flow in the line 38 to a temperature higher than a temperature at which the compressed gas flow entered the second heat exchanger 70. The hot gas flow in the line 26 that passes through the second heat exchanger 70 may thereafter exit the second heat exchanger 70 and exhaust to the atmosphere and out of the system 10. The configuration of the second heat exchanger 70 may thus serve the purpose of raising the temperature of the compressed gas flow in the line 38 prior to the compressed gas flow entering the heat source 14 to thereby preheat the compressed gas flow before the compressed gas flow enters the heat source 14. Preheating the compressed gas flow in the line 38 prior to the compressed gas flow entering the heat source 14 serves to conserve the energy required to create the hot gas flow emanating from the heat source 14.

Embodiments of the system 10 may further comprise a control valve 80 operatively configured in the flow path of the line 26 between the turbine component 24 and the boiler 62. The control valve 80 may be a multi-directional control valve. For example, the control valve 80 may have a plurality of flow ports, such as, for example, flow ports 82A, 82B and 82C. The flow port 82A may be configured as an input port for the hot gas flow from the turbine component 24 to the control valve 80 and may thereby regulate the volume of hot gas flow that enters the control valve 80. The flow ports 82B and 82C may be configured as exit ports for the hot gas flow from the control valve 80 and may thereby regulate, or otherwise modulate, the volume and flow rate of the hot gas flow entering and exiting the control valve 80. For example, when the flow ports 82A and 82C are open and the flow port 82B is closed, the hot gas flow of the line 26 may flow through the control valve 80 to the boiler 62. Further in example, when the flow ports 82A, 82B and 82C are all open, the hot gas flow may be divided at the control valve 80, with a first portion of the hot gas flow being directed out of the flow port 82B through a line 84 that directs the hot gas flow to a third heat exchanger 90, to be described in greater detail herein, and a second portion of the hot gas flow being directed out of the flow port 82C through the line 26 that directs the hot gas flow to the boiler 62. These examples serve to highlight just a few of the flow configurations of the hot gas flow through the control valve 80. Moreover, the control valve 80 may be configured to not only open and close the flow ports 82A, 82B and 82C, but may also be configured to regulate, or otherwise modulate, the flow ports 82A, 82B and 82C to control and direct the flow rate and volume of the hot gas flow through the lines 26 and 84.

Embodiments of the system 10 may further comprise a third heat exchanger 90. The third heat exchanger 90 may be operatively configured in the flow path of the line 84. The third heat exchanger 90 may be, for example, a trim cooler configured to provide the conditions in which heat exchange may take place between the hot gas flow in the line 84 leaving the turbine component 24 prior to entering the boiler 62 and a fluid in a second feedwater line 92. For example, the hot gas flow in the line 84 may be configured to enter the third heat exchanger 90 and exchange heat with the fluid in the second feedwater line 92. As a result, within the third heat exchanger 90, the elevated temperature of the hot gas flow in the line 84 may exchange heat with the fluid in the second feedwater line 92 to lower the temperature of the hot gas flow in the line 84 exiting the third heat exchanger 90 to a temperature lower than a temperature at which the hot gas flow entered the third heat exchanger 90. The hot gas flow in the line 84 that passes through the third heat exchanger 90 may thereafter exit the third heat exchanger 90 and pass to the boiler 62, or, if desired, mix with the second portion of the hot gas flow in the line 26 exiting the exit port 82C of the control valve 80. The configuration of the third heat exchanger 90 may thus serve the purpose of lowering the temperature of the hot gas flow in the line 26, if needed, prior to the hot gas flow entering the boiler 62. Trimming the temperature of the hot gas flow in the line 26 prior to the hot gas flow entering the boiler 62 serves to control the energy required to create the process steam or hot water within the boiler 62.

Embodiments of the system 10 may further comprise a control valve 94 being operatively configured in the feedwater line 92 in communication with the third heat exchanger 90 to thereby adjust, regulate, and otherwise modulate the flow volume and flow rate of the fluid in the second feedwater line 92 that passes through the third heat exchanger 90.

Embodiments of the system 10 may further comprise the system being configured to operate in a number of operating conditions depending upon the demands placed upon the system 10. For example, the system 10 may be configured to operate in conditions in which: (1) both boiler demand and compressor demand are needed or desired; (2) only boiler demand is needed or desired; and (3) only compressor demand is needed or desired. Indeed, the system 10 may be configured to concurrently, adequately and efficiently produce the energy sources of process steam or hot water from the boiler 62 as well as compressed air from the compressor 34 without the demand for and production of either of these energy sources by the system 10 affecting, limiting, or otherwise disturbing the production, quality and availability of the other energy source by the system 10. In other words, the demand and production of the process steam or hot water may be generated by the system 10 without affecting the demand and production of the compressed air generated by the system 10, and vice versa.

Figure 2A:
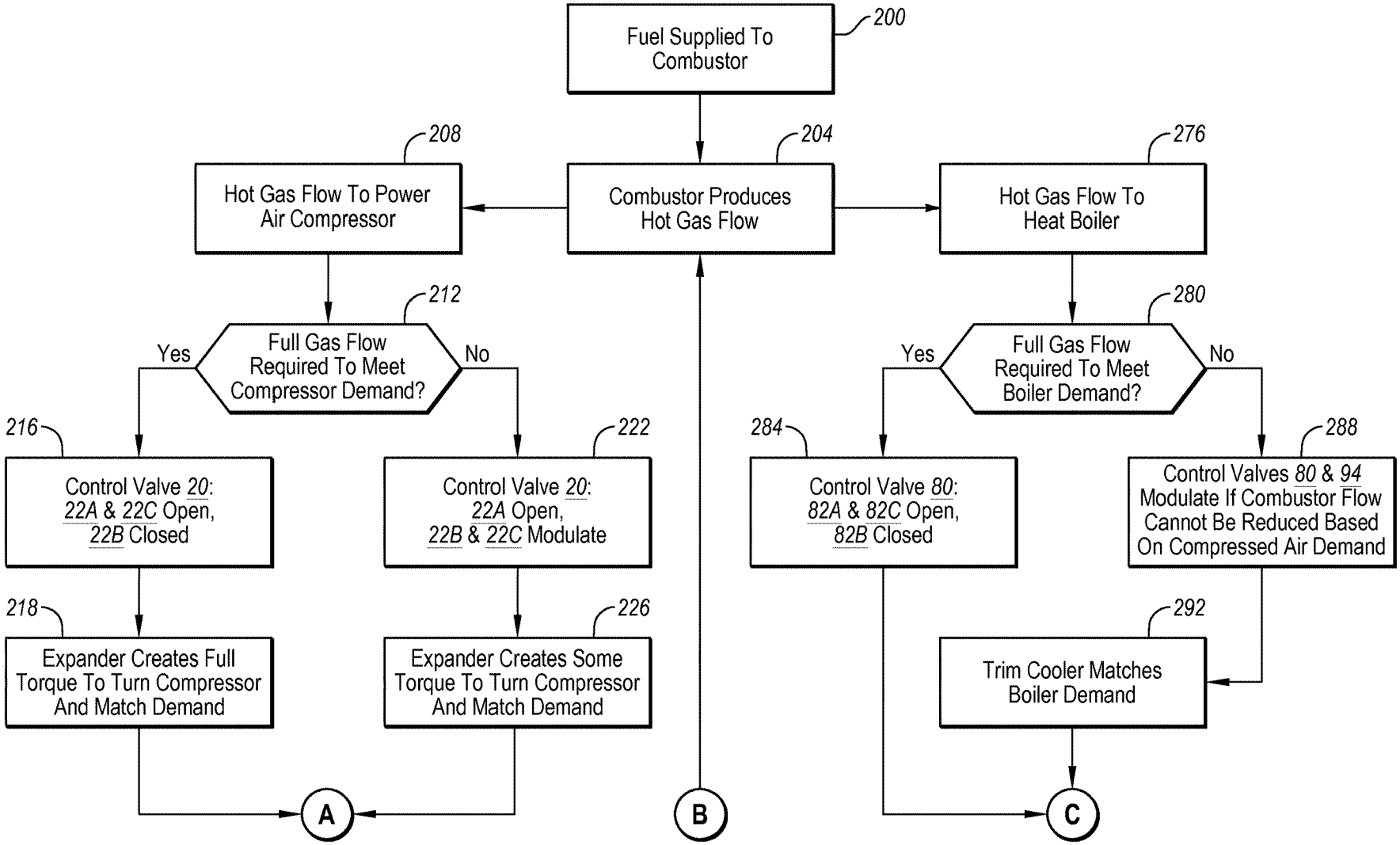
FIG. 2A is a portion of a flow diagram of an illustrative embodiment of an integrated boiler and compressor system in accordance with the present disclosure.
Figure 2B:
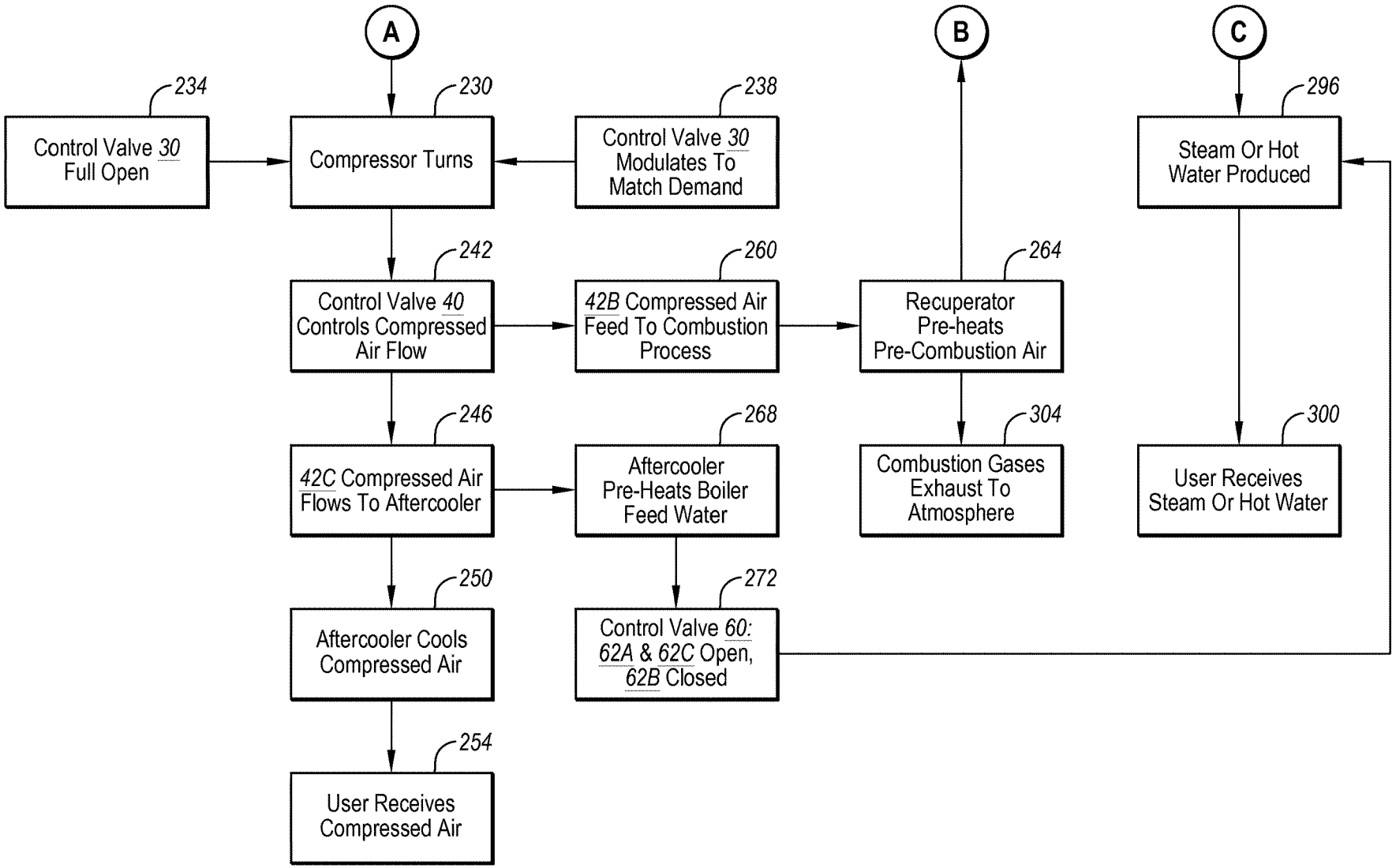
FIG. 2B is a continuation of the flow diagram of FIG. 2A, in accordance with the present disclosure.

With reference to FIG. 2, embodiments of the system 10 may further comprise the system 10 being configured to satisfy demand for the respective energy sources produced by the boiler 62 and by the compressor 34. For example, in the logic step 200, the combustion fuel 8 is supplied to the heat source 14. In the step 204, the heat source 14, operating as a combustion heater, produces a hot gas flow from the combustion of the combustion fuel 8 and a compressed gas. In the step 208, the system 10 utilizes the power stored in the hot gas flow by directing the hot gas flow to the turbine component 24. In the step 212, the system 10 identifies and quantifies the demand placed upon the compressor 34 and decides whether or not full hot gas flow is needed to satisfy the demand.

In the step 216, the system 10 determines that the full hot gas flow is needed to satisfy the demand on the compressor 34 and therefore opens flow ports 22A and 22C of the control valve 20 while closing the flow port 22B of the control valve 20. This allows the full hot gas flow to pass through the control valve 20 and enter the turbine component 24, in step 218, to power the turbine component 24 and generate the requisite torque on the drive shaft 28 to power the compressor 34 to match the demand on the compressor 34.

In the alternative to the step 216, in the step 222, the system 10 determines that the full hot gas flow is not needed to satisfy the demand on the compressor 34 and therefore opens flow port 22A of the control valve 20 and modulates the flow ports 22B and 22C of the control valve 20 to govern the flow rate of the hot gas flow to the turbine component 24. This allows the requisite flow rate of the hot gas flow to pass through the control valve 20 and enter the turbine component 24, in step 226, to power the turbine component 24 and generate the requisite torque on the drive shaft 28 to power the compressor 34 to match the demand on the compressor 34.

In the step 230, the compressor 34 turns and compresses a supply of gas entering the compressor 34 by way of the control valve 30. In the step 234, the control valve 30 may be configured to be fully open to permit the maximum flow rate of the gas into the compressor 34 to match the demand on the compressor 34. In the alternative to the step 234, in the step 238, the control valve may be configured to be partially open to modulate the flow rate of the gas into the compressor 34 to match the demand on the compressor 34.

In the step 242, the compressed air leaving the compressor 34 enters the control valve 40. With demand for the compressed air from the compressor 34 needed at the point of use 50, the flow port 42C of the control valve 40 is open, in the step 246, to govern and modulate the flow of the compressed air to the first heat exchanger 46, i.e., the air cooler. In the step 250, the first heat exchanger 46 cools the compressed air from the compressor 34 by exchanging heat between the compressed air and the fluid in the feedwater line 48. In the step 254, the cooled compressed air is delivered to the point of use 50. With the demand for the process steam or hot water from the boiler 62, the fluid in the feedwater line 48 is preheated in the first heat exchanger 46 by the heat of the compressed air, in step 268. In the step 272, the flow ports 62A and 62C of the control valve 60 are open and the flow port 62B of the control valve 60 is closed to direct the fluid in the feedwater line 48 to freely flow into the boiler 62.

Returning to the step 242, the compressed air leaving the compressor 34 enters the control valve 40. With demand for the compressed air from the compressor 34 needed in the heat source 14, the flow port 42B of the control valve 40 is open, in the step 260, to govern and modulate the flow of the compressed air to the heat source 14, i.e., the combustion heater. In the step 264, the compressed air leaving the control valve 40 by way of the flow port 42B is directed to the second heat exchanger 70 to exchange heat with the hot gas flow exiting the boiler 62.

Jumping now to the step 276, hot gas flow from the heat source 14 is produced for the purpose of heating the fluid in the feedwater line 48 to generate the process steam or hot water. The system 10 may be configured to identify and quantify the demand placed upon the boiler 62 and decide whether or not full hot gas flow is needed to satisfy the demand.

In the step 284, the system 10 determines that the full hot gas flow is needed to satisfy the demand on the boiler 62 and therefore opens flow ports 82A and 82C of the control valve 80 while closing the flow port 82B of the control valve 80. This allows the full hot gas flow to pass through the control valve 80 and enter the boiler 62 to exchange heat with the fluid in the feedwater line 48 to generate the process steam or hot water, in step 296.

In the alternative to the step 284, in the step 288, the system 10 may determine that the full hot gas flow is not needed to satisfy the demand on the boiler 62 and therefore may open flow port 82A of the control valve 80 and modulate the flow ports 82B and 82C of the control valve 80 to govern the flow rate of the hot gas flow to the third heat exchanger 90, i.e., the trimmer, and also to the boiler 62. In the step 292, the third heat exchanger 90 may be configured to reduce, or otherwise trim, the temperature of the hot gas flow directed to the boiler 62 by way of the line 26. The third heat exchanger 90 may reduce the temperature of the hot gas flow directed to the boiler 62 by exchanging heat with the fluid in the feedwater line 92 that passes through the third heat exchanger 90, as described herein. This control valve and flow arrangement allows the requisite flow rate of the hot gas flow to pass through the control valve 80 and enter the boiler 62, in step 296, to generate the requisite heat to adequately heat the fluid in the boiler 62 provided by the feedwater line 48 until on the fluid becomes process steam or hot water. In the step 300, the process steam or hot water from the boiler 62 is made available for use as an energy source.

Reverting back to the step 264, the hot gas flow exiting the boiler 62 may be directed to the second heat exchanger 70, i.e., the recuperator, to heat the compressed gas in the line 38 that is also passing through the second heat exchanger 70. In the step 304, the hot gas flow may exit the second heat exchanger 70 and exhaust the system 10 to atmosphere.

Figure 3A:
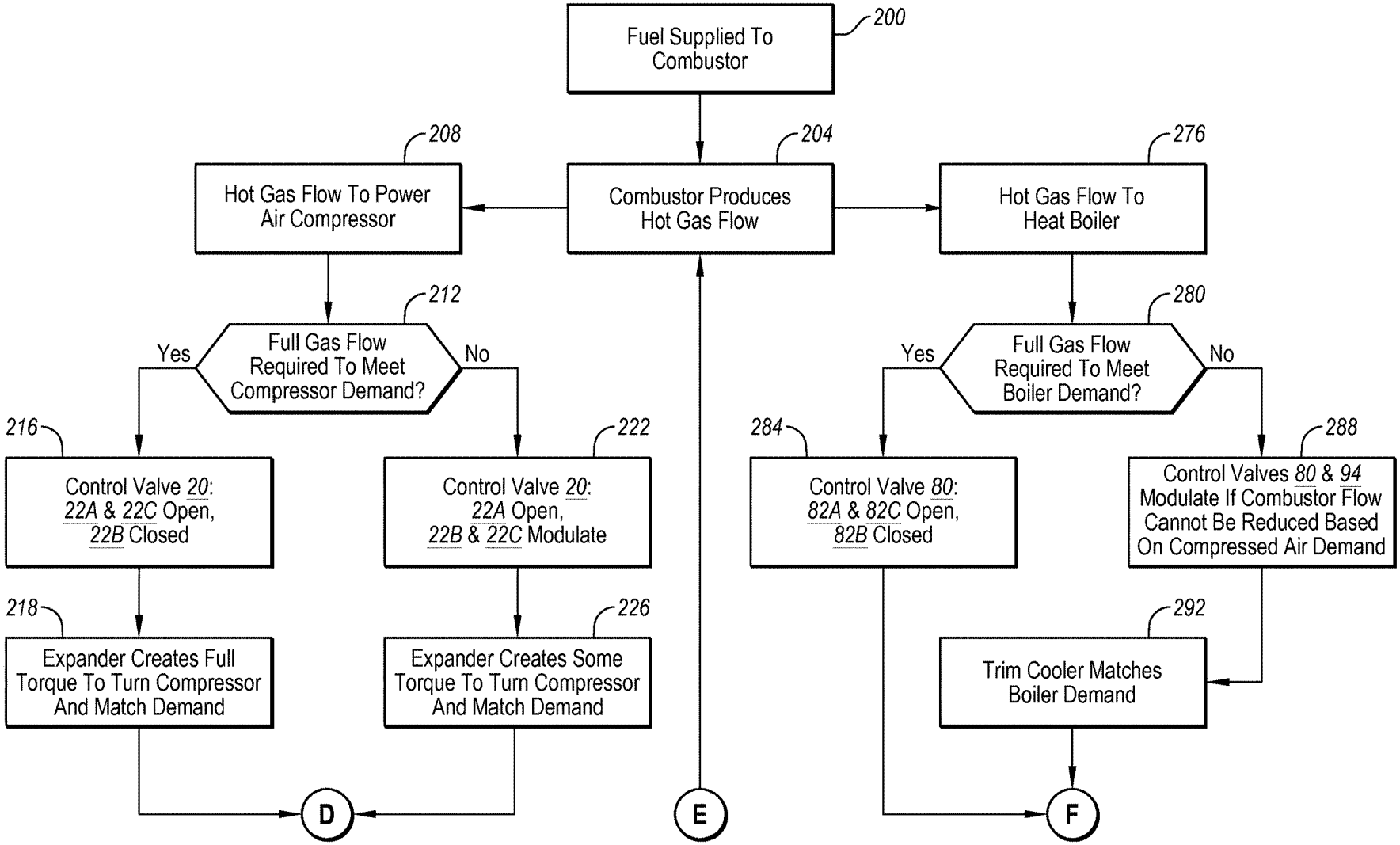
FIG. 3A is a portion of a flow diagram of an illustrative embodiment of an integrated boiler and compressor system in accordance with the present disclosure.
Figure 3B:
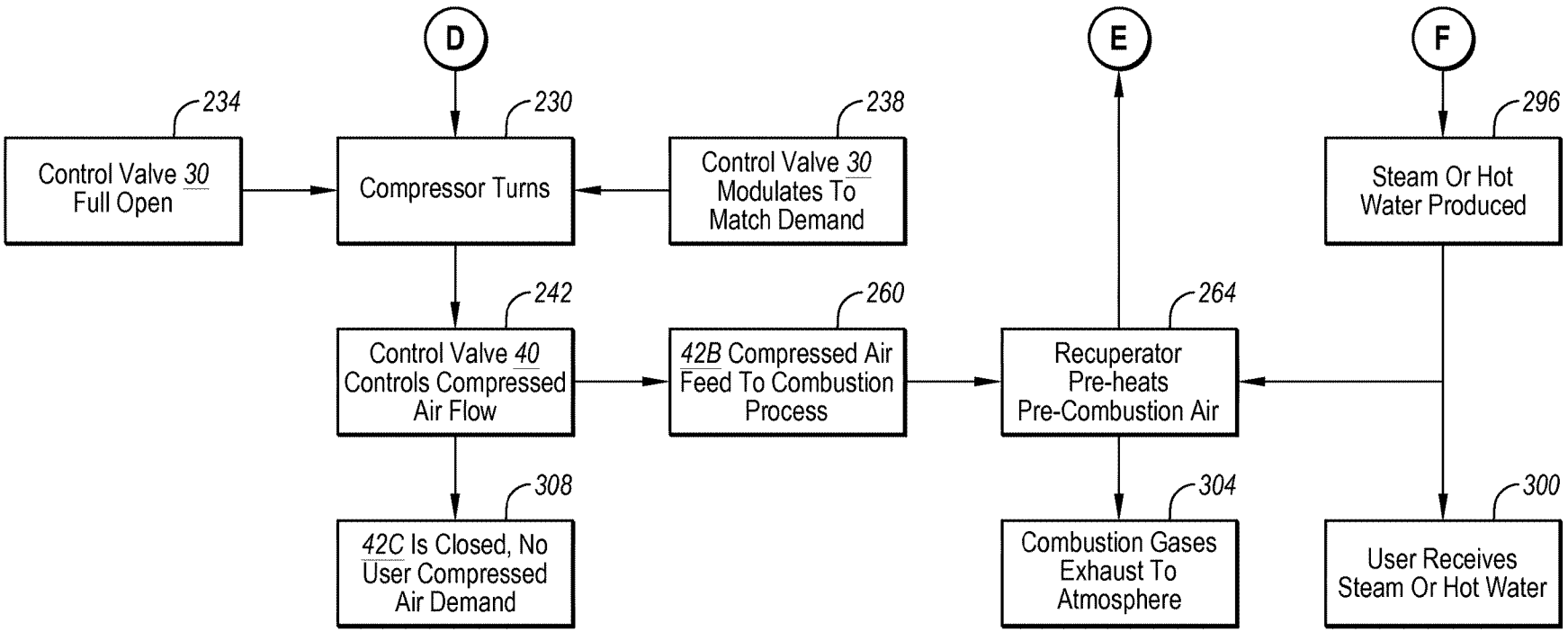
FIG. 3B is a continuation of the flow diagram of FIG. 3A, in accordance with the present disclosure.

With reference to FIG. 3, embodiments of the system 10 may further comprise the system 10 being configured to satisfy demand for the boiler 62 without also having to provide compressed gas to the point of use 50. For example, the steps 200-242, 260, 264 and 276-304 may be similar to those described herein with respect to the operation of the embodiment of the system 10 illustratively depicted in FIG. 2. Thus, these similar steps are appropriately labeled in the embodiment of the system 10 illustratively depicted in FIG. 3. However, because in the embodiment of the system 10 in FIG. 3 no demand is placed on the compressor 34 for the production of compressed gas to the point of use 50, the steps 246, 250, 254, 268 or 272 are not needed and may be omitted. Instead, in the step 308, as shown in FIG. 3, the flow ports 42A and 42B of the control valve 40 are open and the flow port 42C of the control valve 40 is closed to direct the flow of the compressed gas from the compressor 34 through the control valve 40 to the second heat exchanger 70 and further to the heat source 14.

Figure 4A:
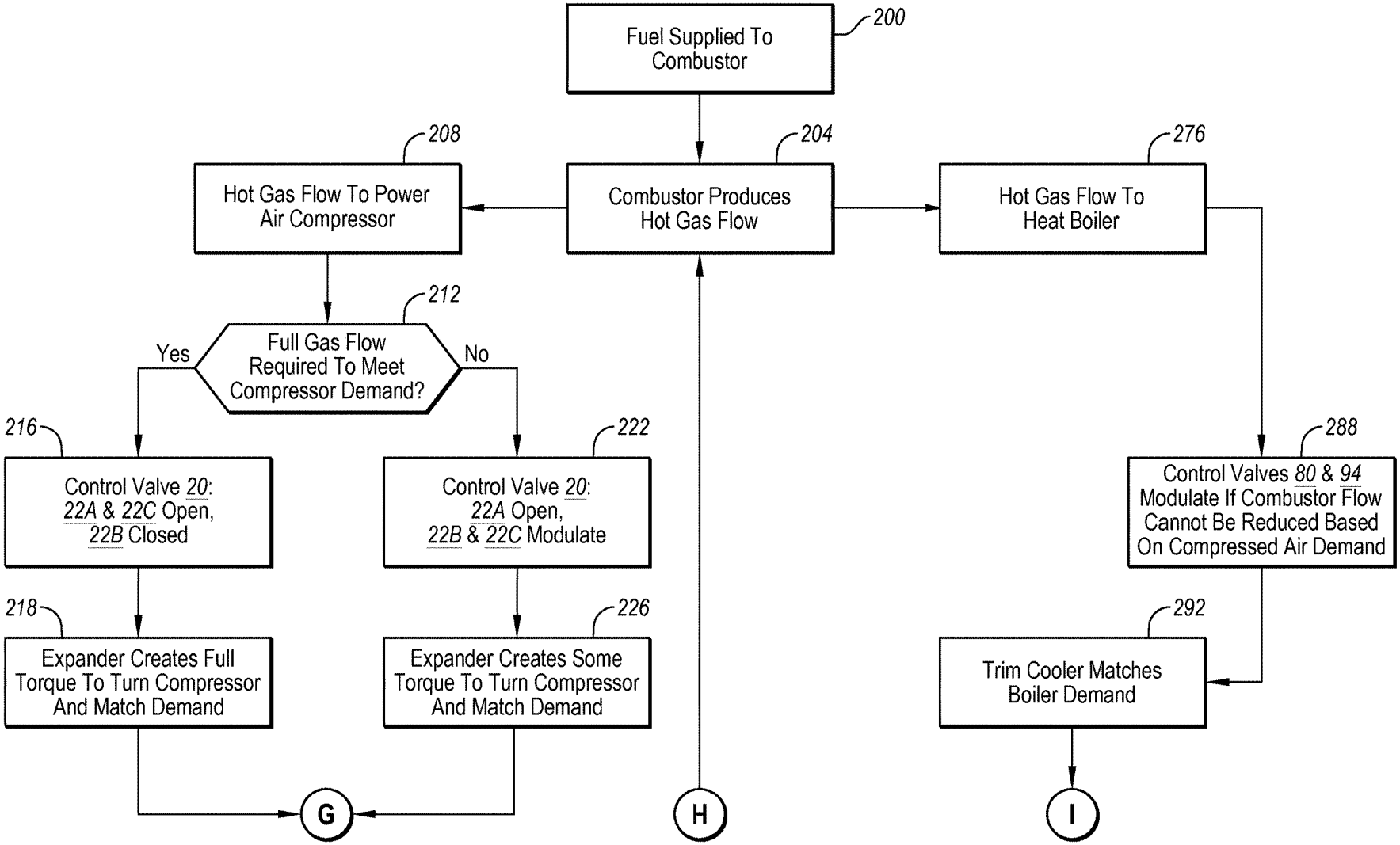
FIG. 4A is a portion of a flow diagram of an illustrative embodiment of an integrated boiler and compressor system in accordance with the present disclosure.
Figure 4B:
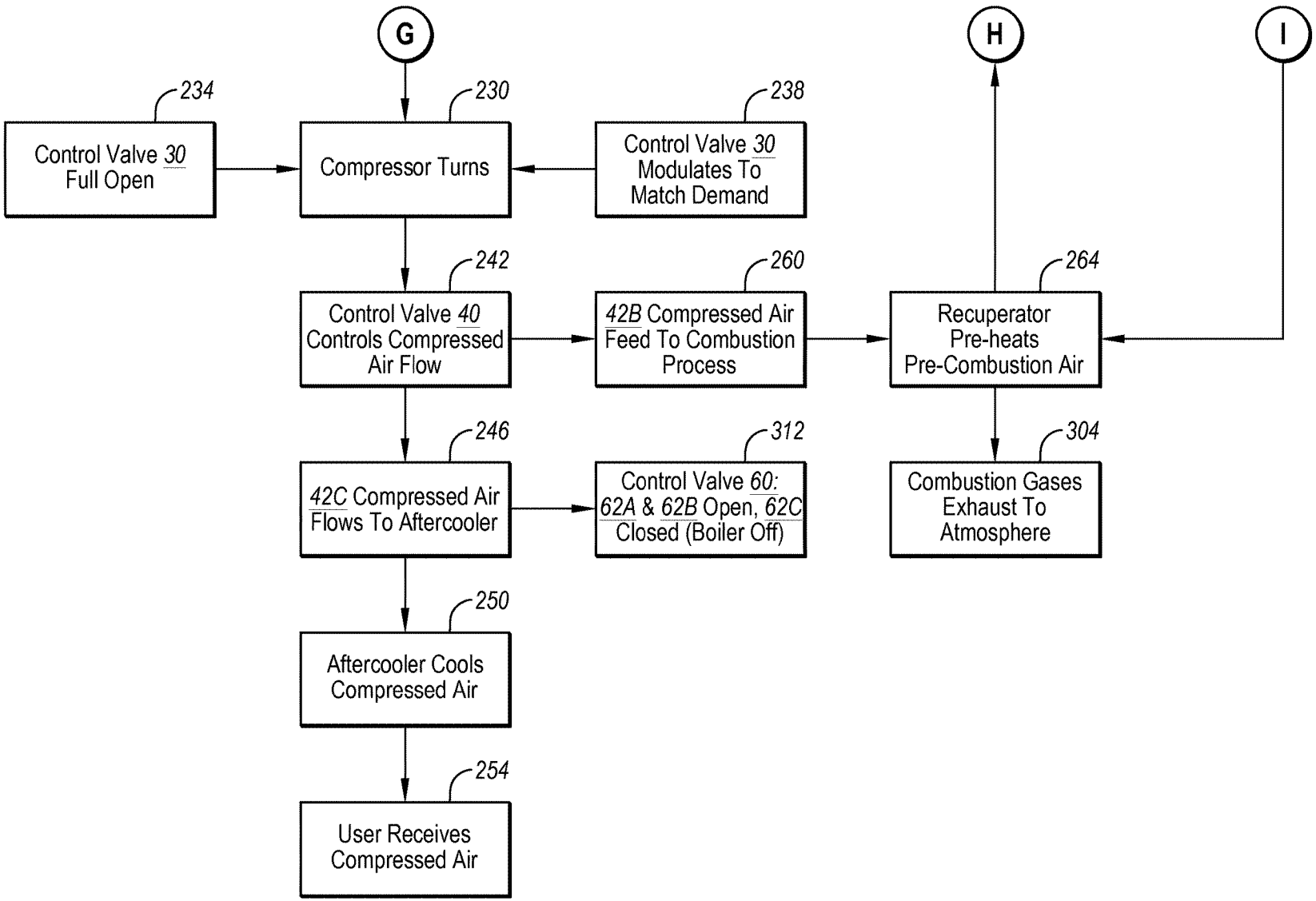
FIG. 4B is a continuation of the flow diagram of FIG. 4A, in accordance with the present disclosure.

With reference to FIG. 4, embodiments of the system 10 may further comprise the system 10 being configured to satisfy demand for the compressor 34 without also having to provide process steam or hot water from the boiler 62. For example, the steps 200-264, 276, 288, 292 and 304 may be similar to those described herein with respect to the operation of the embodiment of the system 10 illustratively depicted in FIG. 2. Thus, these similar steps are appropriately labeled in the embodiment of the system 10 illustratively depicted in FIG. 4. However, because in the embodiment of the system 10 in FIG. 4 no demand is placed on the boiler 62 for the production of process steam or hot water, the steps 268, 272, 280, 284, 296 and 300 are not needed and may be omitted. Instead, in the step 312, as shown in FIG. 4, the flow of the fluid in the feedwater line 48 may be directed through the first heat exchanger 46 to cool the compressed gas in the line 36 flowing through the first heat exchanger 46. Thereafter, the fluid in the feedwater line 48 may be governed by the control valve 60. The flow ports 62A and 62B of the control valve 60 may be open and the flow port 62C of the control valve 60 may be closed to direct the flow of the fluid in the feedwater line 48 through the control valve 60 and out of the system 10, without being at all directed to the boiler 62.

Embodiments of the system 10 may comprise the system 10 having the ability to modulate the various component parts of the system 10, to adjust the performance of the system 10, and to maximize efficiency of the system 10 based on demand placed on the system 10. The control valves 20, 30, 40, 60, 80 and 94 operatively coupled to the component parts of the system 10, as described herein, serve to provide these several features, advantages, and benefits. For example, the ability of the system to provide process steam or hot water from the boiler 62 and compressed gas from the compressor 34 based on user demand can be governed and maximized by way of the control valves. Indeed, the system 10 is configured to perform these functions whether the system 10 works at full or partial load.

The materials of construction of the system 10 and its various component parts, including for example, but not limited thereto, the heat source 14, the turbine component 24, the compressor 34, and the boiler 62, may be formed of any of many different types of materials or combinations thereof that can readily be formed into shaped objects provided that the components selected are consistent with the intended operation of power tools and security lock-out devices of the type disclosed herein. For example, and not limited thereto, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining the above-described system 10 and its various component parts, including for example, but not limited thereto, the heat source 14, the turbine component 24, the compressor 34, and the boiler 62, may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, 3-D printing, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. An integrated power generation system comprising:

a heat source producing a first gas flow;

an expander in flow communication with the first gas flow from the heat source;

a boiler in flow communication with the first gas flow from the expander;

a first control valve positioned in the first gas flow between the heat source and the expander; a bypass line in flow communication with the first control valve such that when the first control valve is in a first orientation the totality of the first gas flow bypasses the expander and is directed to the boiler;

a feedwater flow in flow communication with the boiler;

a compressor operatively coupled to and driven by the expander, the compressor producing a second gas flow divisible into a first portion and a second portion, the first portion in flow communication with the heat source and the second portion in flow communication with a point of use;

a first heat exchanger arranged upstream of the boiler with respect to the feedwater flow and downstream of the compressor in the second portion of the second gas flow, the first heat exchanger in flow communication with the feedwater flow and the second portion of the second gas flow, the first heat exchanger exchanging heat between the second portion of the second gas flow and the feedwater flow whereby heat is drawn out of the second portion of the second gas flow in the first heat exchanger prior to said second portion of the second gas flow being directed to the point of use; and a second heat exchanger arranged downstream of the boiler in the first gas flow and downstream of the compressor in the first portion of the second gas flow, the second heat exchanger exchanging heat between the first gas flow and the first portion of the second gas flow to preheat the first portion of the second gas flow prior to entering the heat source.

2. The system of claim 1, further comprising a third heat exchanger in flow communication with a second feedwater flow and the first gas flow, the third heat exchanger exchanging heat between the first gas flow and the second feedwater flow.

3. The system of claim 2, further comprising a fifth control valve arranged in flow communication between the expander and the third heat exchanger and configured to regulate the first gas flow.

4. The system of claim 2, further comprising a sixth control valve arranged in flow communication with the third heat exchanger and configured to regulate the second feedwater flow through the third heat exchanger.

5. The system of claim 1, further comprising a compressor control valve arranged in flow communication with the compressor and configured to regulate the second gas flow through the compressor.

6. The system of claim 1, further comprising a second control valve arranged in flow communication between the compressor and the first heat exchanger and configured to regulate the first and second portions of the second gas flow.

7. The system of claim 1, further comprising a third control valve arranged in flow communication between the first heat exchanger and the boiler and configured to regulate the feedwater flow.

8. The system of claim 1, further comprising a fourth control valve arranged in flow communication between the heat source and the expander and the boiler and configured to regulate the first gas flow.

9. An integrated power generation system comprising:

a heat source producing a first gas flow;

an expander in flow communication with the first gas flow from the heat source;

a boiler in flow communication with the first gas flow from the expander;

a first control valve of a plurality of control valves positioned in the first gas flow between the heat source and the expander;

a bypass line in flow communication with the first control valve such that when the first control valve is in a first orientation the totality of the first gas flow bypasses the expander and is directed to the boiler;

a feedwater flow in flow communication with the boiler;

a compressor operatively coupled to the expander, the compressor producing a second gas flow divisible into a first portion and a second portion, the first portion flowing to the heat source and the second portion flowing to a point of use;

a first heat exchanger arranged upstream of the boiler in the feedwater flow and downstream of the compressor in the second portion of the second gas flow, the heat exchanger exchanging heat between the second portion of the second gas flow and the feedwater flow to preheat the feedwater flow prior to entering the boiler; and a second heat exchanger arranged downstream of the boiler in the first gas flow and downstream of the compressor in the first portion of the second gas flow, the second heat exchanger exchanging heat between the first gas flow and the first portion of the second gas flow to preheat the first portion of the second gas flow prior to entering the heat source;

wherein the plurality of control valves transition the system between one of a first operation state, a second operation state, and a joint operation state wherein the first and second operation states operate concurrently, wherein in the first operation state the plurality of control valves direct the second portion of the second gas flow to the point of use without the feedwater flow through the boiler and without the first gas flow flowing to the boiler.

10. The system of claim 9, wherein based on a sensed value the plurality of control valves independently regulate the first gas flow to the expander, a gas flow to the compressor, and the first and second portions of the second gas flow.

11. The system of claim 9, wherein in the second operation state the plurality of control valves direct the feedwater flow through the boiler without the second portion of the second gas flow flowing to the point of use.

12. The system of claim 11, wherein based on a sensed value the plurality of control valves independently regulate the first gas flow to the expander, the first gas flow to the boiler, the feedwater flow to the boiler, a gas flow to the compressor, and the first portion of the second gas flow.

13. The system of claim 9, wherein in the joint operation state, the plurality of control valves direct the feedwater flow through the boiler and the second portion of the second gas flow to the point of use.

14. The system of claim 13, wherein based on a sensed value the plurality of control valves independently regulate the first gas flow to the expander, the first gas flow to the boiler, the feedwater flow to the boiler, a gas flow to the compressor, and the first and second portions of the second gas flow.

15. A method of producing power from the integrated power generation system of claim 9, the method comprising:

producing the first gas flow from the heat source;

generating torque from the first gas flow to operate the compressor;

exchanging heat in the boiler between the first gas flow and the feedwater flow;

producing the second gas flow from the compressor;

providing the first portion of the second gas flow to the heat source;

providing the second portion of the second gas flow to a point of use;

exchanging heat between the second portion of the second gas flow downstream of the compressor and the feedwater flow upstream of the boiler; and exchanging heat between the first portion of the second gas flow downstream of the compressor and the first gas flow downstream of the boiler.

16. The method of claim 15, further comprising cooling the first gas flow downstream of the expander by a second feedwater flow prior to entering the boiler.

17. The method of claim 16, wherein the exchanging heat in the boiler and the providing the second portion of the second gas flow to the point of use are selectably operable between independent or concurrent operational states.

18. An integrated power generation system comprising:

a heat source producing a first gas flow;

an expander in flow communication with the first gas flow from the heat source;

a boiler in flow communication with the first gas flow from the expander;

a first control valve positioned in the first gas flow between the heat source and the expander;

a bypass line in flow communication with the first control valve such that when the first control valve is in a first orientation the totality of the first gas flow bypasses the expander and is directed to the boiler;

a single feedwater flow in flow communication with the boiler;

a first compressed gas flow in heat exchange communication with the entire feedwater flow prior to at least a portion of the feedwater flow entering the boiler; and a second compressed gas flow in flow communication with the heat source;

wherein the second compressed gas flow is in heat exchange communication with the single feedwater flow at a location of the feedwater flow upstream of the boiler; and wherein the second compressed gas flow is in heat exchange communication with the first gas flow at a location of the second compressed gas flow prior to the second compressed gas flow entering the heat source and at a location of the first gas flow downstream of the boiler.

19. The system of claim 18, further comprising a compressor operatively coupled to and driven by the expander, the compressor producing the first and second compressed gas flows.

20. The system of claim 19, further comprising a control valve in flow communication with the first and second compressed gas flows to adjust each of the first and second compressed gas flows based on a measured value in the system.

21. The system of claim 18, wherein the first compressed gas flow preheats the feedwater flow.

22. The system of claim 18, wherein the first gas flow preheats the second compressed gas flow.

* * * * *